United States Patent [19]

Crane

[11] Patent Number: 4,516,286

[45] Date of Patent: May 14, 1985

[54] SEWER PIPELINE CLEANING APPARATUS

[76] Inventor: Patrick Crane, 24600 Dry Canyon Cold Creek Rd., Calabasas, Calif. 91302

[21] Appl. No.: 501,523

[22] Filed: Jun. 6, 1983

[51] Int. Cl.[3] ..... B08B 9/02

[52] U.S. Cl. ..... 15/104.12; 15/104.3 R

[58] Field of Search ..... 15/104.09, 104.12, 104.3 R

[56] References Cited

U.S. PATENT DOCUMENTS

| | | | |
|---|---|---|---|
| 3,449,783 | 6/1969 | Kirschke | 15/104.12 |
| 3,525,112 | 8/1970 | Masters | 15/104.12 |
| 3,740,785 | 6/1973 | Latall | 15/104.12 |

FOREIGN PATENT DOCUMENTS

| | | | |
|---|---|---|---|
| 574771 | 4/1976 | Switzerland | 15/104.12 |

*Primary Examiner*—Edward L. Roberts

*Attorney, Agent, or Firm*—David O'Reilly

[57] ABSTRACT

A sewer pipeline cleaning apparatus comprised of a hydraulic motor removably mounted on a frame, connected through a fluid connecting adaptor to a high pressure hose. The hydraulic motor and the fluid connecting adaptor are both removably mounted on the frame so that they may be easily removed for repair or replacement. The motor is mounted in a cylindrical ring attached to the frame and secured by locking screws. The fluid connecting adaptor is mounted in a second cylindrical ring attached to the frame, axially aligned with the first and is secured in the ring by a locking screw. The fluid connecting adaptor is provided with rearwardly facing orifices connected to a passageway through the adaptor for applying a thrust to assist in pushing the sewer pipe cleaning apparatus through a pipeline.

2 Claims, 5 Drawing Figures

SEWER PIPELINE CLEANING APPARATUS

FIELD OF THE INVENTION

This invention relates to sewer pipeline cleaning devices and more particularly relates to a hydraulically motor driven sewer pipeline cleaning apparatus.

BACKGROUND OF THE INVENTION

In sewer pipeline cleaning devices, a cleaning tool such as a root cutter is pushed through a sewer pipeline while being rotated to clean away roots or other debris which may clog the line. Various means are provided for driving the tool. Some of these are in the form of long lines to which the tool is attached.

One type of device has a hydraulic motor called a gerotor having a cleaning tool attached to the motor drive shaft. The motor is driven by fluid under high pressure connected to the motor through a jet thruster secured to the motor casing. The jet thruster is provided with a blind socket which supplies the fluid to the inlet of the motor while simultaneously causing the fluid to apply a thrust to the sewer cleaning apparatus. A disadvantage of this construction is that maintenance of replacement of the jet thruster or motor requires replacement of the entire assembly, as the jet thruster is welded to the motor casing.

The purpose of the present invention is to provide a simplified construction for a sewer pipeline cleaning apparatus.

Still another object of the present invention is to provide a sewer pipeline cleaning apparatus having a hydraulic motor which is readily removable for replacement or repair.

Still another object of the present invention is to provide a sewer pipeline cleaning apparatus having a fluid connecting adaptor separately mounted on a frame from a hydraulic motor.

Still another object of the present invention is to provide a sewer pipeline cleaning apparatus having a pair of spaced apart mounting rings for separately mounting a hydraulic motor and a fluid connecting adaptor for connecting high pressure fluid to the motor.

BRIEF DESCRIPTION OF THE INVENTION

A sewer pipeline cleaning apparatus comprised of a hydraulic motor having an inlet, an outlet and a drive shaft for attachment of sewer cleaning tools, such as root cutting saws. The hydraulic motor is removably mounted on a frame having a plurality of skids for supporting the motor spaced from the interior walls of the pipeline when it is being pushed through the sewer pipeline for cleaning. High pressure fluid is supplied to the hydraulic motor through a fluid connecting adaptor separately mounted on the frame, having a passageway which connects a high pressure fluid hose to a conduit connected to the motor inlet.

A sewer cleaning tool attached to the drive shaft is driven by high pressure fluid through the fluid connecting adaptor and conduit, which rotates the tool as the sewer cleaning apparatus is pushed through a pipeline. The fluid connecting adaptor also has rearwardly facing orifices which apply a thrust to assist in pushing the sewer pipeline cleaning apparatus through the pipe being cleaned.

The hydraulic motor is supported in the frame in a cylindrical ring in which it is slipped and secured by locking screws. Likewise, the fluid connecting adaptor is slipped into a second ring mounted on the frame and secured by locking screws. The fluid connecting adaptor is then connected to the inlet of the hydraulic motor by a conduit. Thus, the motor or the fluid connecting adaptor can be readily removed for maintenance, repair or replacement without the necessity of removing any other part.

Spaced around the frame are skids which maintain the motor and connector centered in the pipeline while it is being pushed through for cleaning. Preferably the skids are also bolted to the frame for removal, repair and replacement if necessary.

The above objects, advantages and other features of the invention will be fully understood from the following detailed description and the accompanying drawings, in which:

DETAILED DESCRIPTION OF THE INVENTION

Figure 1:
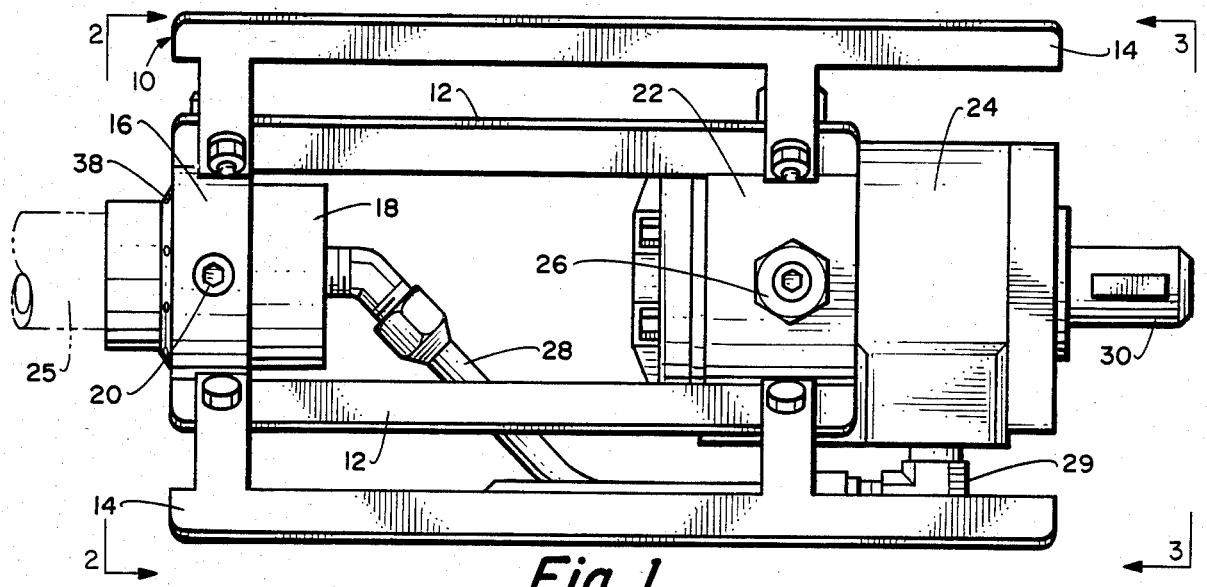
FIG. 1 is a side elevation of a sewer pipeline cleaning apparatus constructed according to the invention.
Figure 2:
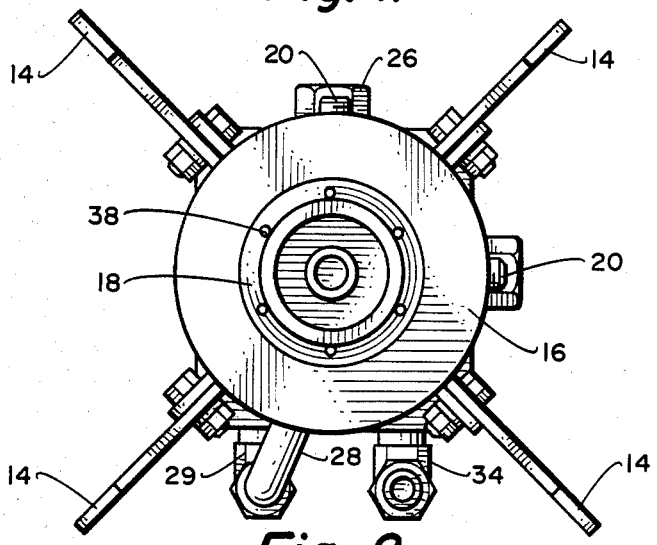
FIG. 2 is an end view of the sewer pipeline cleaning apparatus taken at 2—2 of FIG. 1.
Figure 3:
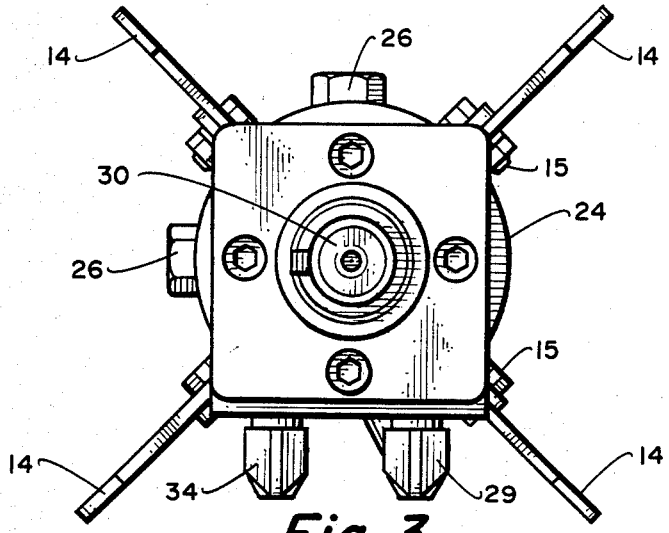
FIG. 3 is an end view of the sewer pipeline cleaning apparatus taken at 3—3 of FIG. 1.

A sewer pipeline cleaning apparatus according to the invention is illustrated in FIG. 1 and is comprised of a frame 10 having longitudinal bracing members 12 and skids 14 spaced around the frame, removably attached by bolts 15. At one end of the frame a cylindrical mounting ring 16 supports a fluid connecting adaptor 18 which is locked by means of allen screws 20. At the other end of the frame, a motor mounting ring 22 supports a hydraulically driven motor 24 which is also clamped in place by one or more allen screws 26. The drive shaft 30 of the hydraulic motor is driven by high pressure fluid supplied through a conduit 28 connected to a motor inlet 29. The other end of the conduit 28 is connected to a passageway through the fluid connecting conduit 18. The other end of the passageway through the fluid connecting conduit 18 is connected to a high pressure hose which applies high pressure fluid to the conduit 28 and motor 24.

Figure 5:
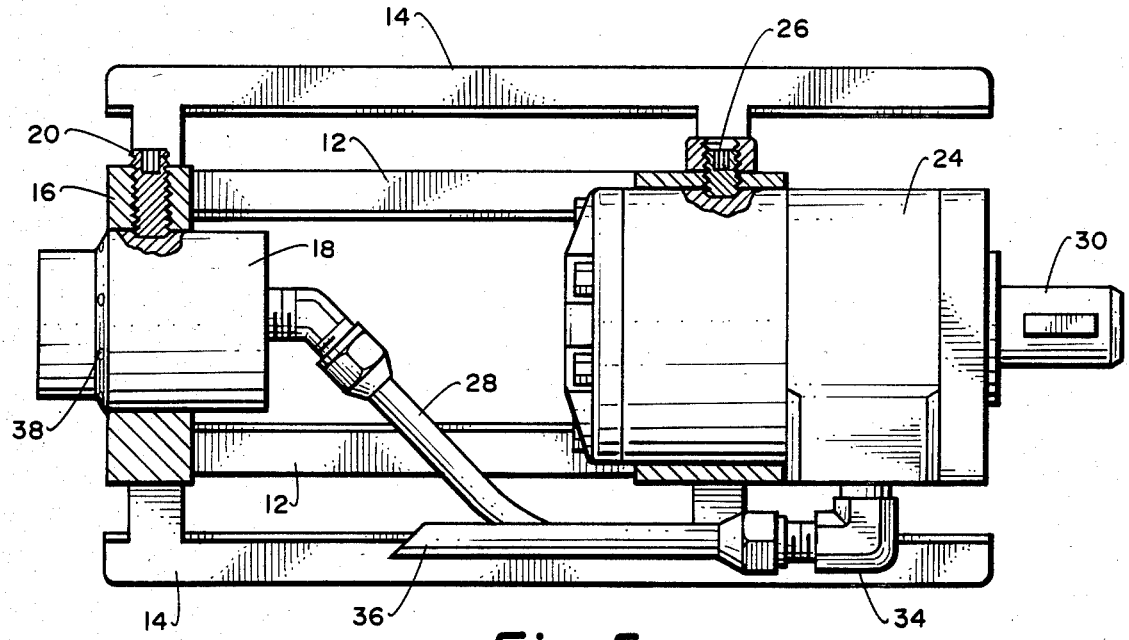
FIG. 5 is a partial sectional view taken at 5—5 of FIG. 4.

A sewer cleaning tool (not shown), such as a root cutter, is attached to the drive shaft 30 of the hydraulic motor. The high pressure fluid or water supplied through the fluid connecting adaptor 18 to conduit 28 drives the motor 21 which rotates the drive shaft 30, and any cutting tool attached, at high speeds. The fluid delivered to the motor 24 is discharged through outlet 34 to an exhaust pipe 36 (FIG. 5).

Figure 4:
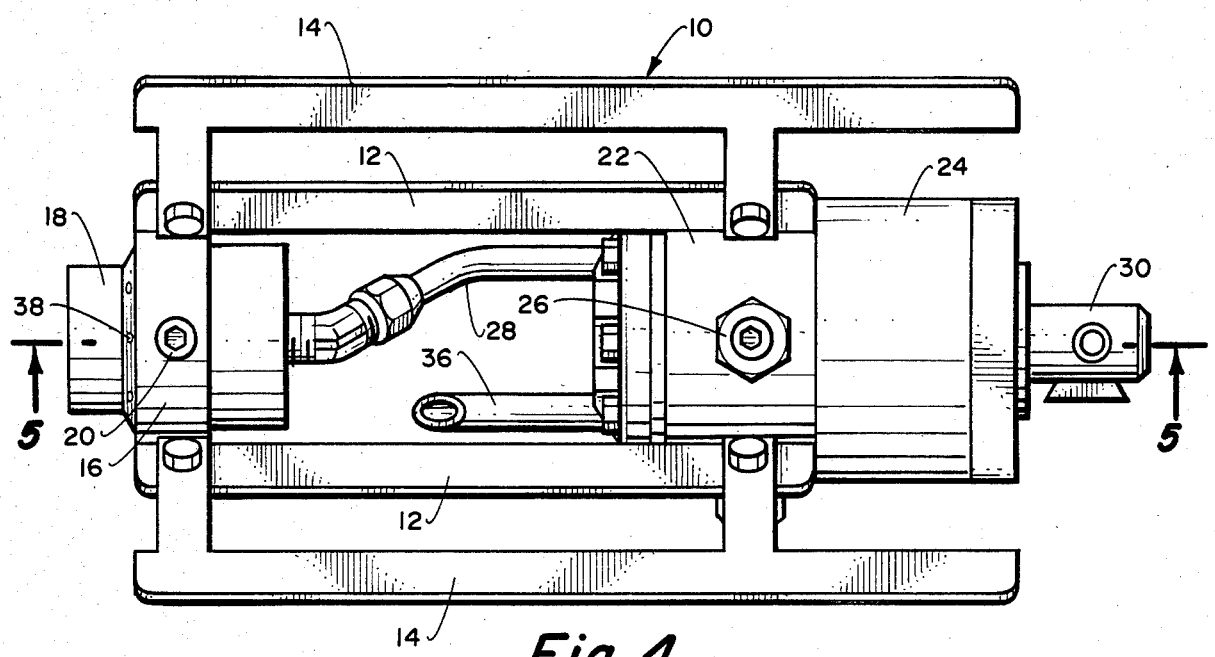
FIG. 4 is a top view of the sewer pipeline cleaning apparatus.

A particular advantage of the construction of the sewer pipeline cleaning apparatus disclosed is that parts may be easily removed for repair, maintenance or replacement as they are all individually or separately mounted components. As can be seen in FIGS. 4 and 5 the motor 24 is secured in cylindrical ring 22 by allen screws 26. By simply loosening these screws and disconnecting conduit 28, the motor can be slipped out of the mounting ring 22 for routine maintenance, repair or replacement. Likewise, the fluid connecting adaptor 18 can be similarly removed from cylindrical mounting ring 16 by simply loosening the one or more locking allen screws 20, disconnecting the conduit 28 and hose 25 and slipping the fluid connecting adaptor 18 out of the cylindrical ring. Preferably, there are two locking screws at approximate right angles to each other to limit rotational movement of the hydraulic motor or the fluid connecting adaptor in their mounting rings.

In addition to the straight through passageway from the high pressure hose 25 to the conduit 28 in the fluid connecting adaptor 18, a plurality of rearwardly facing orifices 38 are provided which are in communication with the passageway through the fluid connecting adaptor 18. Fluid flowing through the passageway in the fluid connecting adaptor 18, because of the high pressure and the smaller diameter of the conduit 28 in relationship to the high pressure hose 25, forces fluid out of the orifices 38, applying a thrust to assist in pushing the sewer cleaning apparatus through a pipeline.

Thus, there are separate assemblies so that parts may be individually removed for easy replacement, repair or maintenance. The frame is comprised of cylindrical rings 16 and 22 welded or otherwise fastened to longitudinal members or struts 12. To the frame are bolted skids 14 of which there are four approximately equally spaced around the frame. More could be easily provided if desired. The motor 24 is slipped into the cylindrical ring 22 and secured by means of two allen screws 26 at 90° to each other to securely lock the motor in the mounting ring 22. The fluid connecting adaptor, having a through passageway for delivering high pressure fluid to the motor, is mounted in cylindrical mounting ring 16 and also securely locked by two allen screws at 90° angles 26. The high pressure hose 25 is threaded into interior threads (not shown) in the end of the fluid connecting adaptor 18 and the conduit connected by means of conduit couplings to the motor inlet 29 and the outlet of the fluid connecting adaptor 18. An exhaust pipe 36 is connected to the outlet 34 of the hydraulic motor 24.

As was previously described, in operation a sewer cleaning tool is attached to drive shaft 30 and a high pressure hose is connected to fluid connecting adaptor 18. The sewer cleaning apparatus is then placed in a sewer pipeline to be cleaned. High pressure water is supplied through the hose to the fluid connecting adaptor through the conduit 28 to the hydraulic motor 24 to rotate the drive shaft 30 and the attached sewer cleaning tool. The orifices 38 assist in pushing the sewer cleaning apparatus through the pipeline, cleaning out debris or roots or other clogging material. Additional sections of high pressure hose are added as the sewer cleaning tool progresses through the pipeline.

Thus, there has been disclosed a simplified sewer cleaning apparatus in which parts may be easily removed and replaced and is simple and efficient to use.

This invention is not to be limited by the embodiment shown in the drawings and described in the description, which is given by way of example and not of limitation, but only in accordance with the scope of the appended claims.

What is claimed is:

1. In a sewer pipeline cleaning apparatus having a hydraulic motor with a drive shaft, an inlet for connecting a high pressure hydraulic fluid to drive a sewer cleaning tool attached to said drive shaft the improvement comprising;

a rigid frame formed of first and second cylindrical rings connected by a plurality of stiffening struts;

clamp means removably clamping said hydraulic motor in said first cylindrical ring;

a fluid connecting adaptor having a fluid inlet and outlet and rearwardly facing orifices connected to a passageway through said fluid connecting adaptor;

connecting means connecting a high pressure fluid supply to the inlet of said fluid connecting adaptor, said high pressure fluid providing a thrust through said rearwardly facing orifices;

conduit means connecting said outlet from said fluid connecting adaptor to said hydraulic motor inlet;

second clamp means removably clamping said fluid connecting adaptor in said second cylindrical ring separately from said hydraulic motor;

a plurality of skids bolted to said struts for holding said frame with said hydraulic motor and fluid connecting adaptor spaced from the interior wall of a sewer pipeline being cleansed;

whereby the hydraulic motor, fluid connecting adaptor and skids may be separately removed for repair or replacement.

2. The apparatus according to claim 1 in which said first and second cylindrical rings are constructed to have diameters for slidably receiving said hydraulic motor and fluid connecting adaptor; said first and second clamping means comprising at least one locking set screw mounted in each of said cylindrical rings.

* * * * *